US005588258A

United States Patent [19]

Wright et al.

[11] Patent Number: 5,588,258

[45] Date of Patent: Dec. 31, 1996

[54] POWER OPERATOR FOR PIVOTABLE VEHICLE CLOSURE ELEMENT

[75] Inventors: Kevin Wright, Southfield; Lloyd W. Rogers, Jr., Shelby; Robert W. Baughman, Mt. Clemens; David J. Chapman, Sterling Heights, all of Mich.

[73] Assignee: General Motors Corporation, Detroit, Mich.

[21] Appl. No.: 396,992

[22] Filed: Mar. 1, 1995

[51] Int. Cl.[6] ..... E05F 11/24

[52] U.S. Cl. ..... 49/340

[58] Field of Search ..... 49/124, 323, 324, 49/339, 340

[56] References Cited

U.S. PATENT DOCUMENTS

| | | | |
|---|---|---|---|
| 1,795,452 | 3/1931 | Smelser . | |
| 2,770,454 | 11/1956 | Turtle | 49/324 X |
| 3,022,108 | 2/1962 | Cooley | 296/57 |
| 3,713,472 | 1/1973 | Dozois | 160/189 |
| 3,747,271 | 7/1973 | Adamski | 49/340 |
| 4,026,071 | 5/1977 | Sessa | 49/352 |
| 4,186,521 | 2/1980 | Hunter | 49/30 |
| 4,735,292 | 4/1988 | Munz | 187/56 |
| 4,903,435 | 2/1990 | Bittmann et al. | 49/340 |
| 5,025,591 | 6/1991 | DeLand et al. | 49/360 |
| 5,046,283 | 9/1991 | Compeau et al. | 49/138 |
| 5,137,294 | 8/1992 | Martin | 280/166 |
| 5,147,106 | 9/1992 | Bartelt et al. | 296/202 |
| 5,316,365 | 5/1994 | Kuhlman et al. | 296/155 |
| 5,323,570 | 6/1994 | Kuhlman et al. | 49/360 |
| 5,448,856 | 9/1995 | Moore et al. | 49/340 |

FOREIGN PATENT DOCUMENTS

| | | | |
|---|---|---|---|
| 0139269 | 9/1986 | European Pat. Off. . | |
| 2139839 | 12/1973 | France . | |
| 164995 | 6/1990 | Japan | 49/340 |
| 2138493 | 10/1984 | United Kingdom . | |

*Primary Examiner*—Kenneth J. Dorner
*Assistant Examiner*—Jerry Redman
*Attorney, Agent, or Firm*—Jeffrey A. Sedlar

[57] ABSTRACT

An operator including an extensible strut, a power drive unit and at least one drive cable connected between the power drive unit and the extensible strut is provided for powered opening and closing of pivotable vehicle closure elements such as doors, hoods, liftgates, tailgates, and hatches

8 Claims, 5 Drawing Sheets

POWER OPERATOR FOR PIVOTABLE VEHICLE CLOSURE ELEMENT

BACKGROUND OF THE INVENTION

The present invention relates to power operation of a vehicle's closure elements and more particularly, to power operation thereof by means of a cable driven bi-directional strut.

power operation of vehicle closure elements such as doors, hoods, liftgates and tailgates is, in principle known in the prior art. Convenience and ergonomic related benefits associated with providing power operation of closure elements are readily apparent. A growing marketplace trend toward preferring such convenience and in certain cases necessary features exists. However, this recognized desire must be translated into a feasible system. She widespread commercialization of power operated pivotable vehicle closure elements has yet to occur. Therefore, a need continues to exist for a relatively non-complex, competitive and reliable means of power operation which readily permits manual actuation of a pivotable closure element in its normal state.

SUMMARY OF THE INVENTION

According to the present invention an operator including an extensible strut having a powered drive unit with a normally free-wheeling output means has at least one drive cable connected between the drive unit and the strut for powered opening and closing of a pivotable vehicle closure element such as a door, hood, liftgate, tailgate, hatch and the like. The extensible strut includes a pair of links slidably engaging each other, one pivotably fixed to the vehicle's structure and the other pivotably fixed to the closure element. Preferably, the drive cable is connected to a length of chain which extends around a rotatable sprocket fixed to one of the links and is connected to the other link. This structure produces a strut of reduced thickness while maintaining high strength and provides the capability for an extended operational life. A dependable means of power operating a pivotable closure element is provided through a relatively simple mechanical means which preserves the option of conventional manual operation of the closure element in the normal state.

DETAILED DESCRIPTION OF THE PRESENTLY PREFERRED EMBODIMENT

Figure 1:
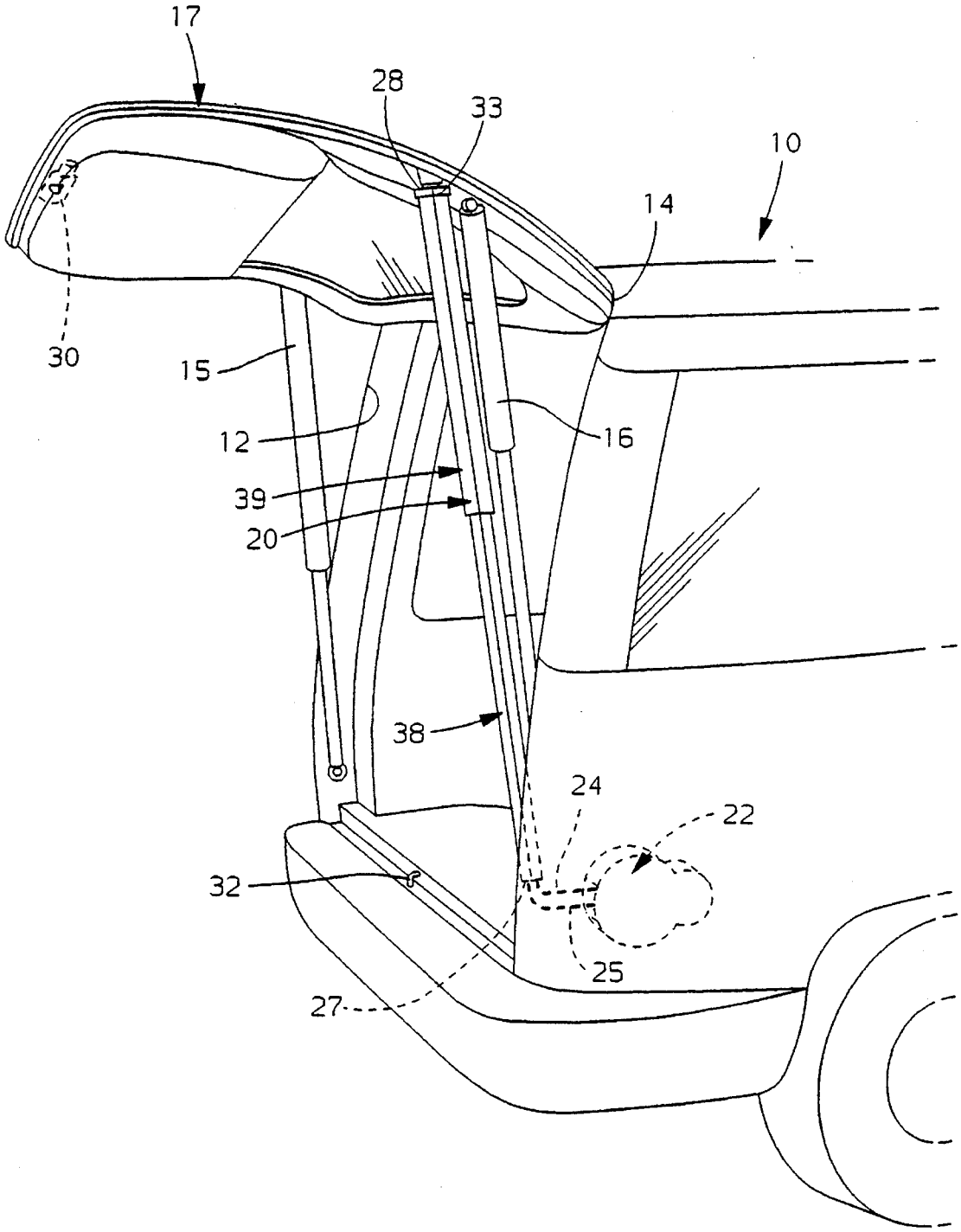
FIG. 1 is a fragmented perspective view of a vehicle showing a powered strut applied to a liftgate.

Illustrated in FIG. 1 is an operator including a strut 20 adapted for cable drive by means of drive unit 22 as applied to operate a vehicle liftgate 17. Liftgate 17 pivots about end 14 and operates as a conventional openable closure element for opening 12 of vehicle 10. Therefore, liftgate 17 is merely illustrative of the closure elements that strut 20 is applicable to operate.

Liftgate 17 includes conventional gas-charged struts 15 and 16 which assist in manual operation of liftgate 17 and maintain liftgate 17 in a pivoted fully open position as illustrated. Open drive cable 24 and close drive cable 25 extend between drive unit 22 and strut 20. Conventionally known guide grooves or rollers (not illustrated) are positioned near the end 27 of strut 20 to assist the drive cables 24 and 25 in arcuate travel between drive unit 22 and strut 20. Liftgate 17 includes power operated latch and cinching mechanism 30 which engages striker 32 when moved near the closed position. Power operated latch and cinching mechanism 30 works in cooperation with strut 20 to complete and initiate closure and opening respectively, of liftgate 7.

Gas-charged struts 15 and 16 are generally incapable of pivoting liftgate 17 from the closed position to the open position when unassisted by power operation of strut 20 and apply a force working against closure of liftgate 17 when effected by operation of strut 20. Gas-charged struts 15 and 16 are however, capable of maintaining liftgate 17 in its fully opened position when moved thereto. Therefore, strut 20 must create sufficient force to operate against the action of gas-charged struts 15 and 16 in closing liftgate 17.

Figure 5:
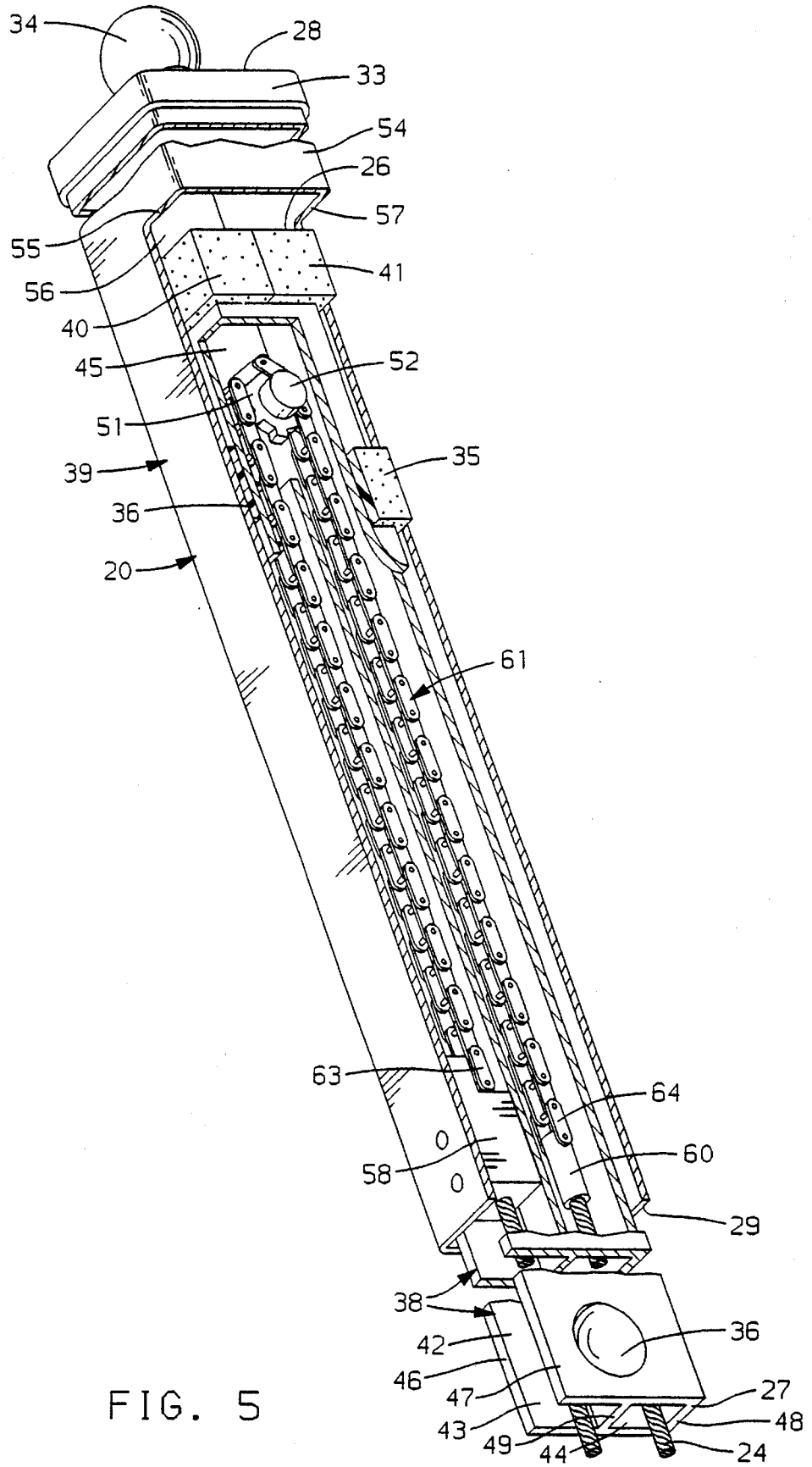
FIG. 5 is a fragmented perspective illustration of a powered strut.

Referring to FIG. 5, strut 20 is illustrated in greater detail. End cap 33 includes ball 34 at end 28 of strut 20. Ball 34 pivotably engages a socket (not illustrated) on liftgate 17. Strut 20 also includes socket opening 36 near end 27 for pivotably engaging a ball (not illustrated) attached to vehicle 10. Strut 20 generally comprises fixed link 38 which is pivotally connected to vehicle 10 by means of socket 36 and moving link 39 which is pivotally connected to liftgate 17 by means of ball 34.

Fixed link 38 and moving link 39 engage each other in a telescopic relationship wherein fixed link 38 is slidably received within moving link 39. Four plastic guide shoes 35, 36, 40 and 41, are affixed to fixed link 38 in pairs to provide a low friction sliding contact between fixed link 38 and moving link 39.

Fixed link 38 includes two longitudinal chambers 43 and 44 formed by sidewalls 46, 47, and 48 and which are separated by internal wall 49, internal wall 49 extends from end 27 through fixed link 38, stopping short of end 26, thereby, forming sprocket chamber 45. Sprocket chamber 45 includes sprocket 51 which is rotatably fixed to fixed link 38 by pin.

Moving link 39 includes four walls 54–57. Connector 58 is fixed to the inside surface of wall 55 near end 29 of moving link 39. Connector 58 extends through the open side 42 of fixed link 38 and therefore, travels through chamber 43 when moving link 39 slides relative to fixed link 38. Connector 58 preferably includes a conventional cable tensioning means (not illustrated).

Close drive cable 25 extends into chamber 43 of fixed link 38 and is fixed to the cable tensioning means of connector 58. Open drive cable 24 extends into chamber 44 and by means of end fitting 60 is connected to a chain 61 which is conventionally formed of a plurality of links. Chain 61 includes end 63 which is connected to connector 58 and end 64 which is connected to end fitting 60. From end 63, chain 61 extends through chamber 43, into sprocket chamber 45 where it engages sprocket 51 providing a 180 degree turn, then exits sprocket chamber 45 and extends through chamber 44 to end 64. By utilizing chain 61 to provide the 180 degree turn around sprocket 51, a strut 20 of the required strength is provided with a relatively small cross section through use of a relatively small diameter sprocket 51. Therefore, the overall space requirements of strut 20 are reduced as compared to a completely cable driven mechanism. However, where space limitations are not a concern, the 180 degree turn may be provided through cable and pulley operation.

In operation, strut 20 is extended whereby, moving link 39 slides relative to fixed link 38, by applying a pulling force to open drive cable 24 and coordinatedly providing slack in close drive cable 25. Strut 20 is retracted by applying a pulling force to close drive cable 25 while coordinatedly providing slack in open drive cable 24. The location of connector 58, socket 36 and ball 34 are selected to align the forces on strut 20 with the vertical axis to reduce bending forces between links 38 and 39.

Figure 2:
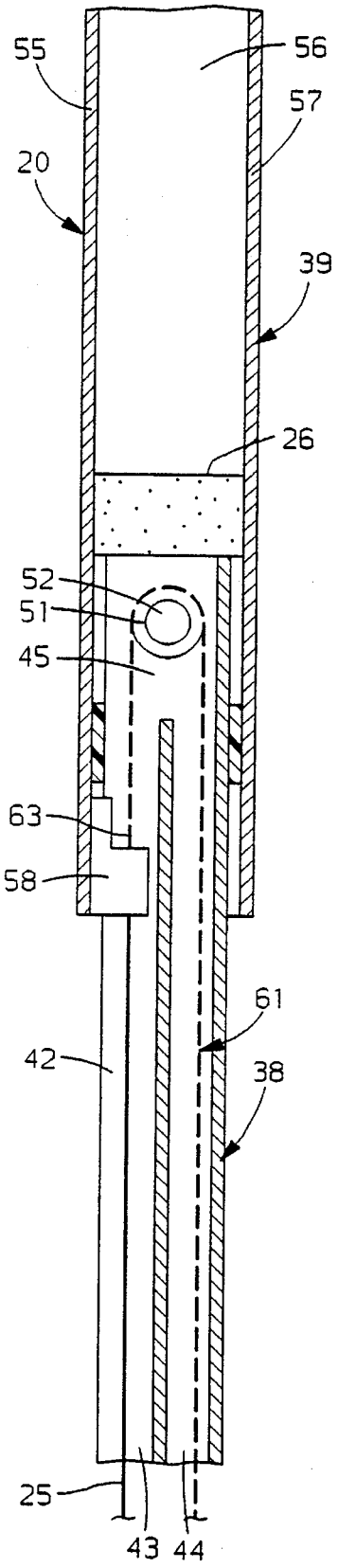
FIG. 2 is a schematic illustration of a powered strut.
Figure 3:
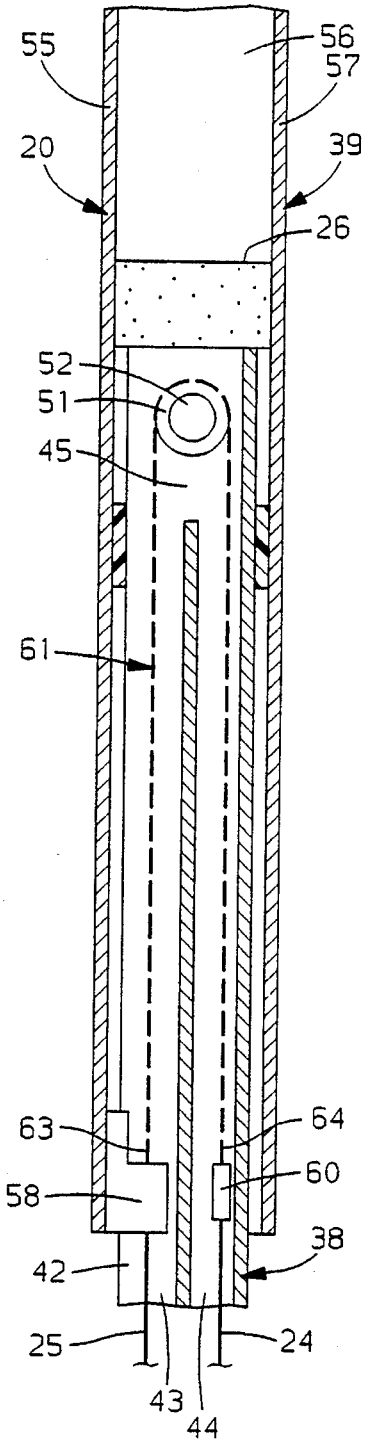
FIG. 3 is a schematic illustration of a powered strut.
Figure 4:
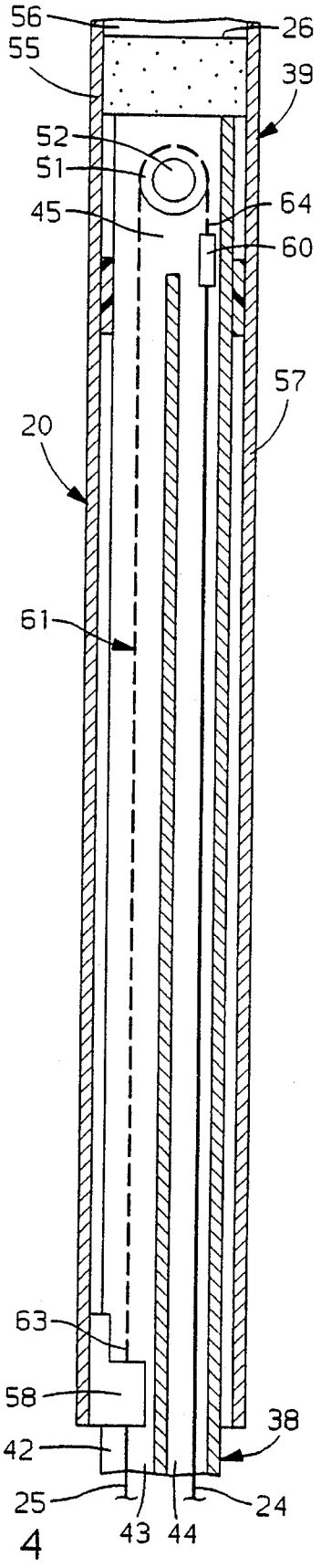
FIG. 4 is a schematic illustration of a powered strut.

Referring to FIGS. 2–4, strut 20 is schematically shown in various states of extension. FIG. 2 shows moving link 39 substantially fully extended. End 63 of chain 61 is substantially approaching sprocket 51. At this point the relative rigidity of strut 20 depends on guide shoes 35, 36, 40 and 41 which are positioned between links 38 and 39 near end 29 of moving link 39.

FIG. 3 illustrates strut 20 in an intermediate position, moved from the position of FIG. 2 towards the retracted position by means of applying a pulling force to close drive cable 25 while coordinatedly providing slack in open drive cable 24. Movement of the moving link 39 by means of cables 24 and 25, chain 61 and sprocket 51 provides a system wherein substantially all forces acting on the strut 20 are longitudinal wherein, lateral or bending forces on links 38 and 39 are minimized.

FIG. 4 illustrates strut 20 substantially in the fully retracted position. End 64 of chain 61 and end fitting 60 are substantially approaching sprocket 51. In this position all four guide shoes 35, 36, 40 and 41 are positioned near end 28 of moving link 39. This coincides with the point when the maximum extending force is required to be applied to strut 20 to move the liftgate 17 from the fully closed position, as released by latch 30, toward an open position.

Figure 6:
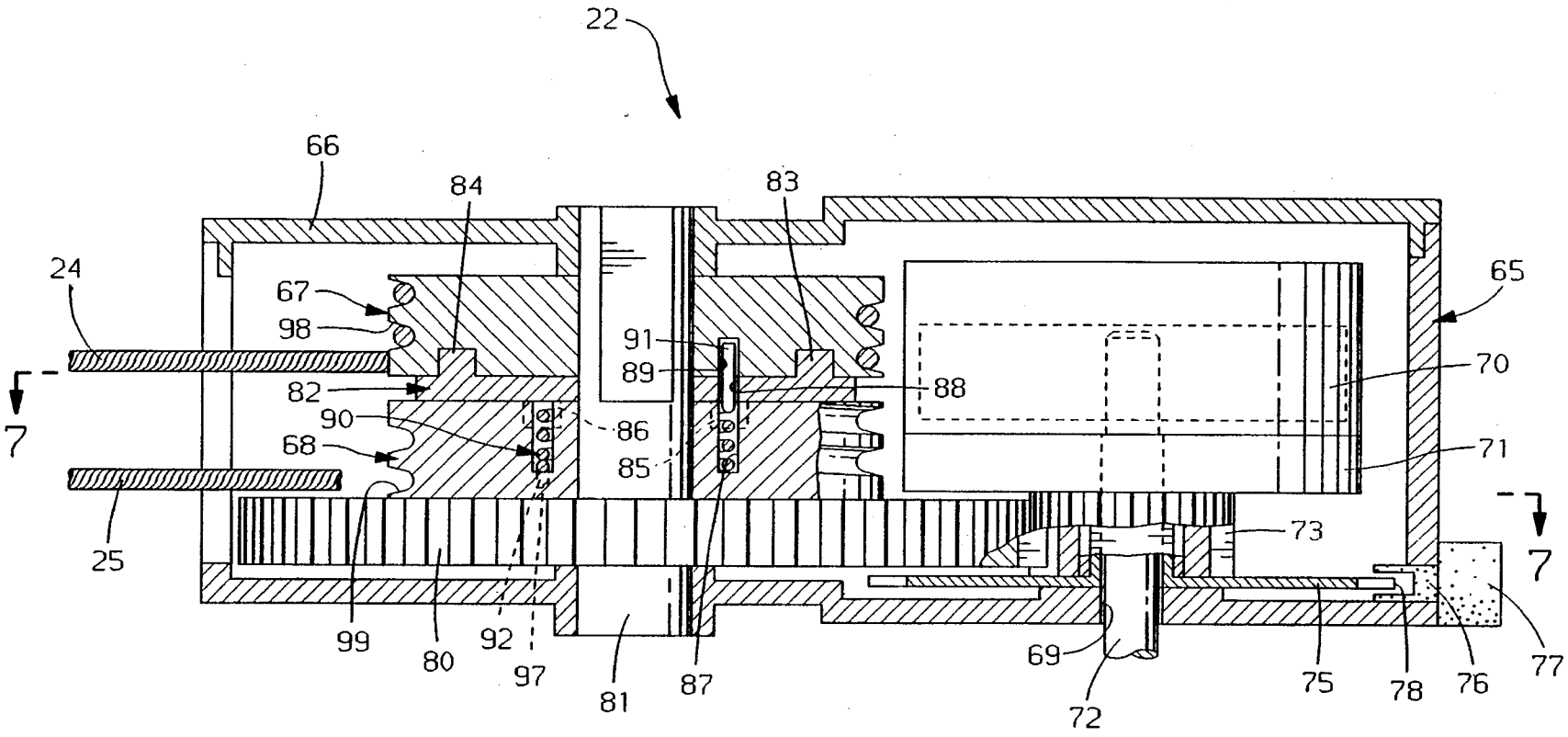
FIG. 6 is a fragmented cross-sectional illustration of a power drive unit.

Referring to FIG. 6, the drive unit 22 is illustrated in greater detail. Drive unit 22 provides a means of applying a pulling force to one of the drive cables 24 or 25 while simultaneously providing slack in the other drive cable to extend or retract the strut 20. Drive unit 22 includes housing 65 which is closed by cover 66. An electric motor (not illustrated) includes motor shaft 72 which extends through opening 69 in housing 65 and engages electromagnetic clutch 70. Electromagnetic clutch 70 is rotatably carried by motor shaft 72. Friction plate 71 is positioned about motor shaft 72 adjacent electromagnetic clutch 70. Friction plate 71 is connected with pinion 73 which is also positioned about motor shaft 72. When energized, electromagnetic clutch 70 is operable to engage friction plate 71 providing a means of selectively transferring rotational motion from motor shaft 72 to pinion 73.

Pinion 73 engages slotted disk 75. Slotted disk 75 includes an outer periphery 78 which travels in a rotational path through sensor 76. Sensor 76 communicates rotational data from drive unit 22 by means of electrical connector 77 to electronic control means (not illustrated).

Pinion 73 also engages output drive gear 80 which is fixed to and rotatably carried by shaft 81. Therefore, when friction plate 71 is not engaged by electromagnetic clutch 70, output gear 80, in coordination with pinion 73, is freely rotatable on shaft 81 allowing drive pulleys 67 and 68 to rotate during manual actuation of liftgate 17. Shaft 81 engages drive disk 82 for providing rotational motion thereto.

Figure 7:
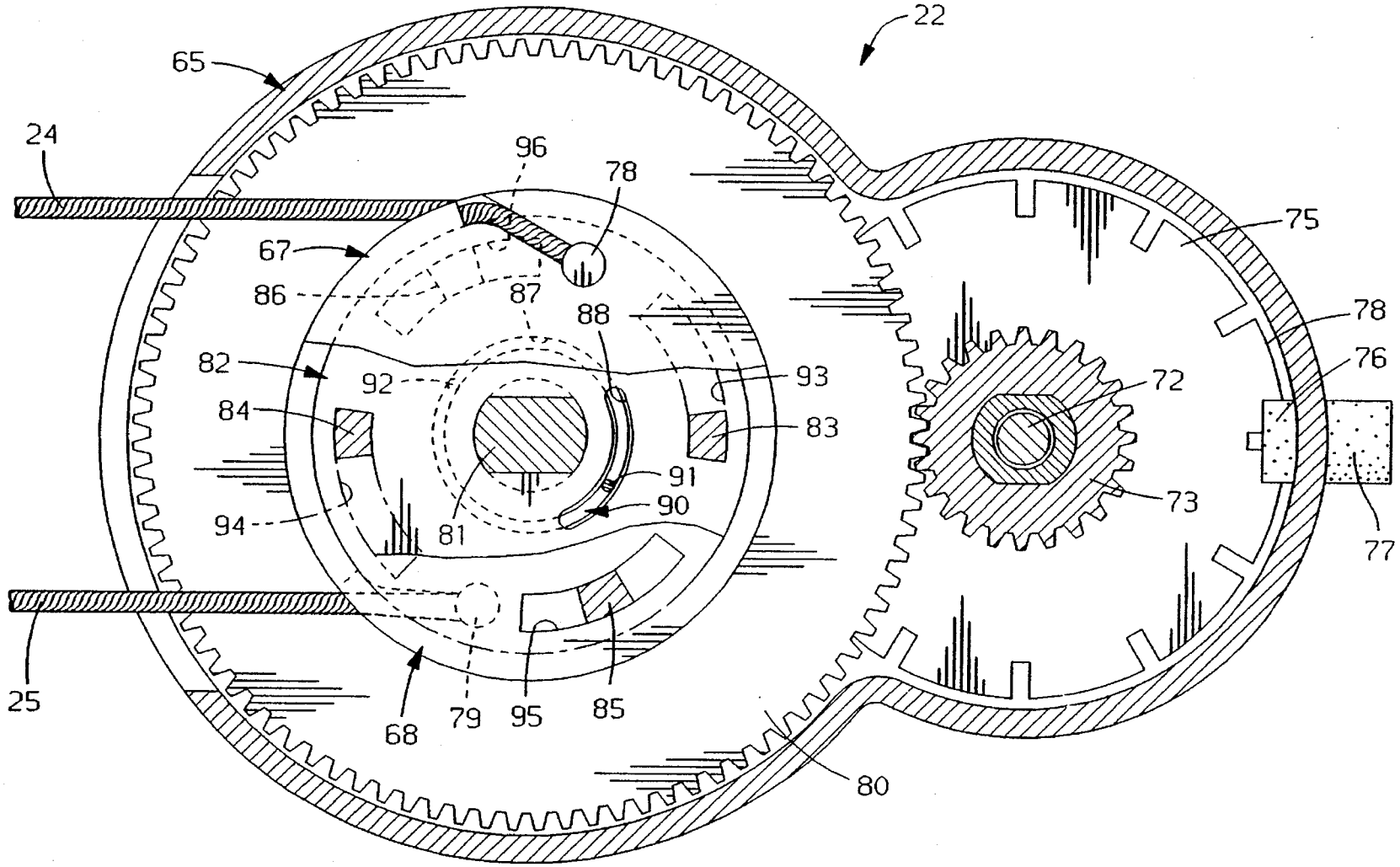
FIG. 7 is a cross-sectional view taken generally through the plane indicated by the line 7—7 in FIG. 6.

Referring additionally to FIG. 7, drive disk 82 includes lugs 83 and 84 which engage drive pulley 67 in arcuate slots 93 and 94 respectively. Drive disk 82 also includes lugs 85 and 86 which engage drive pulley 68 in arcuate slots 95 and 96 respectively. Lugs 83–86 of drive disk 82 provide a lost motion drive connection between the drive gear 82 and the drive pulleys 67 and 68.

A torsion spring 90 is carried between drive pulley 67 and drive pulley 68 and is positioned in annular slot 87 of drive pulley 68 and includes leg 91 which extends into arcuate slot 88 in drive disk 82 and hole 89 of drive pulley 82. Torsion spring 90 also includes leg 92 which is positioned in opening 97 of drive pulley 68. Torsion spring 90 operates to urge drive pulley 67 in a clockwise direction as viewed in FIG. 7 and similarly operates to urge drive pulley 68 in a counterclockwise direction. This acts to maintain cables 24 and 25 in tension at all times.

Drive cable 24 includes an end 78 fixed in drive pulley 67 and drive cable 25 includes an end 79 fixed in drive pulley 68. As best shown in FIG. 6, drive pulleys 67 and 68 include spiral cable grooves 98 and 99 respectively. Through this structure a means of providing opening and closing motion to strut 20 through drive cables 24 and 25 is provided.

In operation, the liftgate 17 is opened manually in the conventional manner. For power operation, an electrical control means (not illustrated), is provided whereby opening and closing of liftgate 17 is effected by switch means (not illustrated), or remote controller means (not illustrated).

Power opening of liftgate 17 is effected by selected energization of the electrical control means wherein power operated latch and cinching mechanism 30 disengages from striker 32 and power drive unit 22 initiates operation, power drive unit 22 effects coordinated rotation of drive pulleys 67 and 68 wherein drive cable 24 is wound onto drive pulley 67 and simultaneously, drive cable 25 is unwound from drive pulley 68. As cable 24 is wound into power drive unit 22, moving link 39 is extended from fixed link 38 and the liftgate 17 is pivoted open.

Power closing of liftgate 17 is effected by selected energization of the electrical control means wherein power drive unit 22 initiates operation. Power drive unit 22 effects coordinated rotation of drive pulleys 67 and 68 wherein drive cable 24 is unwound from drive pulley 67 and simultaneously, drive cable 25 is wound onto drive pulley 68. As cable 25 is wound into power drive unit 22, moving link 39 is retracted onto fixed link 38 and the liftgate 17 is pivoted substantially closed against the applied force of gas-charged struts 15 and 16 wherein power operated latch and cinching mechanism 30 engages striker 32. Subsequently, power operated latch and cinching mechanism 30 completes closure of liftgate 17.

What is claimed is:

1. An operator in combination with a closure element of a vehicle comprising:

a power drive unit;

an extensible strut including a first and second link slidably engaging each other and connectable between the closure element and the vehicle;

a first drive cable connected between the power drive unit and the strut;

a sprocket rotatably fixed to the first link;

a connector fixed to the second link; and a chain extending through the strut from the connector around the sprocket and connected to the first drive cable.

2. An operator according to claim 1 further comprising a second drive cable connected between the power drive unit and the strut.

3. An operator according to claim 2 wherein the second drive cable is connected to the strut at the connector.

4. An operator according to claim 3 wherein the power drive unit is operable to pull the first drive cable extending the extensible strut and is operable to pull the second drive cable retracting the extensible strut.

5. An operator in combination with a closure element of a vehicle comprising:

a power drive unit;

an extensible strut having a first line and a second link slidably engaging each other in a telescopic relationship connected between the closure element and the vehicle;

a first and a second drive cable engaging the power drive unit and the extensible strut; and a gas-charged strut connected between the closure element and the vehicle.

6. An operator according to claim 5 wherein the gas-charged strut exerts an applied force opposing retraction of the extensible strut.

7. An operator according to claim 5 further comprising at least one plastic guide shoe positioned between the first and second links.

8. An operator according to claim 5 wherein the power drive unit includes a first drive pulley engaging the first drive cable, a second drive pulley engaging the second drive cable, a drive disk engageable with the fist and the second drive pulleys, a motor and a clutch and drive train operative to selectively engage the motor with the drive disk.

* * * * *